US010309184B2

(12) United States Patent
Waterhouse et al.

(10) Patent No.: US 10,309,184 B2
(45) Date of Patent: Jun. 4, 2019

(54) RETRIEVABLE PLUGGING TOOL FOR TUBING

(71) Applicant: Weatherford Technology Holdings, LLC, Houston, TX (US)

(72) Inventors: Francis Waterhouse, Leduc (CA); Brian Hilhorst, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 303 days.

(21) Appl. No.: 15/286,335

(22) Filed: Oct. 5, 2016

(65) Prior Publication Data

US 2017/0101843 A1 Apr. 13, 2017

Related U.S. Application Data

(60) Provisional application No. 62/238,841, filed on Oct. 8, 2015.

(51) Int. Cl.

| | |
|---|---|
| ***E21B 23/00*** | (2006.01) |
| ***E21B 23/04*** | (2006.01) |
| ***E21B 33/12*** | (2006.01) |
| ***E21B 34/00*** | (2006.01) |
| ***E21B 34/10*** | (2006.01) |
| ***E21B 33/134*** | (2006.01) |

(52) U.S. Cl.

CPC ..... *E21B 33/12* (2013.01); *E21B 23/00* (2013.01); *E21B 23/04* (2013.01); *E21B 33/134* (2013.01); *E21B 34/10* (2013.01); *E21B 34/101* (2013.01); *E21B 34/102* (2013.01); *E21B 34/103* (2013.01); *E21B 34/105* (2013.01); *E21B 2034/007* (2013.01)

(58) Field of Classification Search

CPC ..... E21B 33/134; E21B 33/12; E21B 34/105; E21B 23/00; E21B 34/102; E21B 34/103; E21B 34/101; E21B 2034/007; E21B 34/10

See application file for complete search history.

(56) References Cited

U.S. PATENT DOCUMENTS 4,574,894 A * 3/1986 Jadwin ..... E21B 21/103 137/118.03

5,398,763 A 3/1995 Watson et al.

(Continued)

OTHER PUBLICATIONS

Weatherford, "TrueFrac(R): Composite Frac Plug," Brochure, copyright 2015, 4-pgs.

(Continued)

*Primary Examiner* — Blake E Michener
(74) *Attorney, Agent, or Firm* — Blank Rome LLP

(57) ABSTRACT

A retrievable locking ball landing tool of the present disclosure allows for fluid circulation while running in the well. Once a plug (e.g., ball) is pumped downhole, the tool allows pressure isolation to activate hydraulic component(s) of a liner string or the like. Being retrievable, the tool eliminates the need to drill out of aluminum components once the setting operations are complete. The retrievable tool can also be used as a bridge plug to allow for wellbore isolation for a period of time. For example, the tool used as a bridge plug can be used to set a liner assembly and can suspend the well until future stimulation can be completed.

23 Claims, 7 Drawing Sheets

(56) References Cited

U.S. PATENT DOCUMENTS

| | | | | |
|---|---|---|---|---|
| 7,921,915 | B2 * | 4/2011 | Richard | E21B 34/14 166/334.4 |
| 8,505,623 | B2 | 8/2013 | Williamson | |
| 9,033,041 | B2 | 5/2015 | Baihly et al. | |
| 2010/0101807 | A1 | 4/2010 | Greenlee et al. | |
| 2012/0073828 | A1 * | 3/2012 | Churchill | E21B 21/103 166/373 |
| 2012/0312557 | A1 * | 12/2012 | King | E21B 34/103 166/386 |
| 2015/0226031 | A1 * | 8/2015 | Hekelaar | E21B 34/10 166/298 |

OTHER PUBLICATIONS

Baker Hughes, "Liner Hanger Systems: Insert Liner Cementing Equipment," Catalog, copyright 2010, pp. 1, 84 & 92.

* cited by examiner

RETRIEVABLE PLUGGING TOOL FOR TUBING

CROSS-REFERENCE TO RELATED APPLICATIONS

This application claims the benefit of U.S. Provisional Appl. 62/238,841, filed 8 Oct. 2015, which is incorporated herein by reference in its entirety.

BACKGROUND OF THE DISCLOSURE

A locking ball landing collar has been used as a blanking collar in liner applications to permanently block the flow path at the toe of a liner system. As shown in FIG. 1, for example, a system 20 is shown having a rig 22, a pump system 24, and a liner system 30. The liner system 30 includes a liner top packer 32 coupled to a liner hanger 34 from which the liner 36 extends. A landing collar 50 with a ball seat is coupled to the liner 36. Further downhole, the liner 36 includes a float collar 40 and a float shoe 42. The liner system 30 is run and set in the wellbore 10 with a running tool (not shown) and known procedures. The collar 50 is installed in conjunction with the standard float equipment 40, 42 and provides a primary barrier between the inner dimension of the liner 36 and the formation so liner accessories can be hydraulically activated.

FIG. 2 illustrates a partial cross-sectional view of a locking ball landing collar 50 according to the prior art for use with a liner system (e.g., 30 in FIG. 1). As shown, the collar 50 includes a body 52 in which a housing 54 affixes. The body 52 has box and pin connections 53*a-b* for threading onto sections of tubing, such as a liner (not shown). A sleeve 56 is movably disposed in the housing 54 and is temporarily held by shear screws 60 in an open condition relative to windows 62 on the housing 54.

A body lock ring 58 can be disposed between the sleeve 56 and the interior 55 of the housing 54 to lock the sleeve 56 in a closed condition once moved downward to shear the screws 60. A ratchet surface defined in the housing's interior 55 can engage the body lock ring 58 to hold the sleeve 56 closed. A stud 64 disposed on the end of the housing 54 has an external seal 66 to seal against the inside 57 of the sleeve 56. This closes off fluid communication through the housing's windows 62 so that the collar 50 can close off fluid communication.

During installation, the collar 50 is open and allows fluid flow through the liner (36: FIG. 1). When the liner and accessories need to be set, a setting ball (not shown) is circulated into a seat 59 of the collar's sleeve 56. The application of internal pressure in the liner (36) then shears the collar's sleeve 56 closed and permanently blocks the flow path through the liner (36). This blocked flow path allows the liner system (30) and other accessories to be pressure cycled and hydraulically set.

When set, for example, the collar 50 isolates pressure above it, after circulation, in order to actuate other hydraulic components in the liner system. Pressure integrity is maintained if the ball rolls off the ball seat 59 in horizontal conditions. The collar 50 has been used in cemented and uncemented liner installations where hydraulically actuated accessories are installed.

The collar has also been used in multi-zone open hole completions. The collar is ran into the well above the float equipment and below open hole packers used for multi-zone isolation. Landing a ball into the collar then allows for pressure isolation in the liner to set the hydraulic packers.

The subject matter of the present disclosure is directed to overcoming, or at least reducing the effects of, one or more of the problems set forth above.

SUMMARY OF THE DISCLOSURE

A retrievable locking ball landing tool of the present disclosure allows for fluid circulation while running in the well. Once a plug (e.g., ball) is pumped downhole, the tool allows pressure isolation to activate hydraulic component(s) of a liner string or the like. Being retrievable, the tool eliminates the need to drill out of aluminum components once the setting operations are complete. The retrievable tool can also be used as a bridge plug to allow for wellbore isolation for a period of time. For example, the tool used as a bridge plug can be used to set a liner assembly and can suspend the well until future stimulation can be completed.

The foregoing summary is not intended to summarize each potential embodiment or every aspect of the present disclosure.

DETAILED DESCRIPTION OF THE DISCLOSURE

Figure 3:
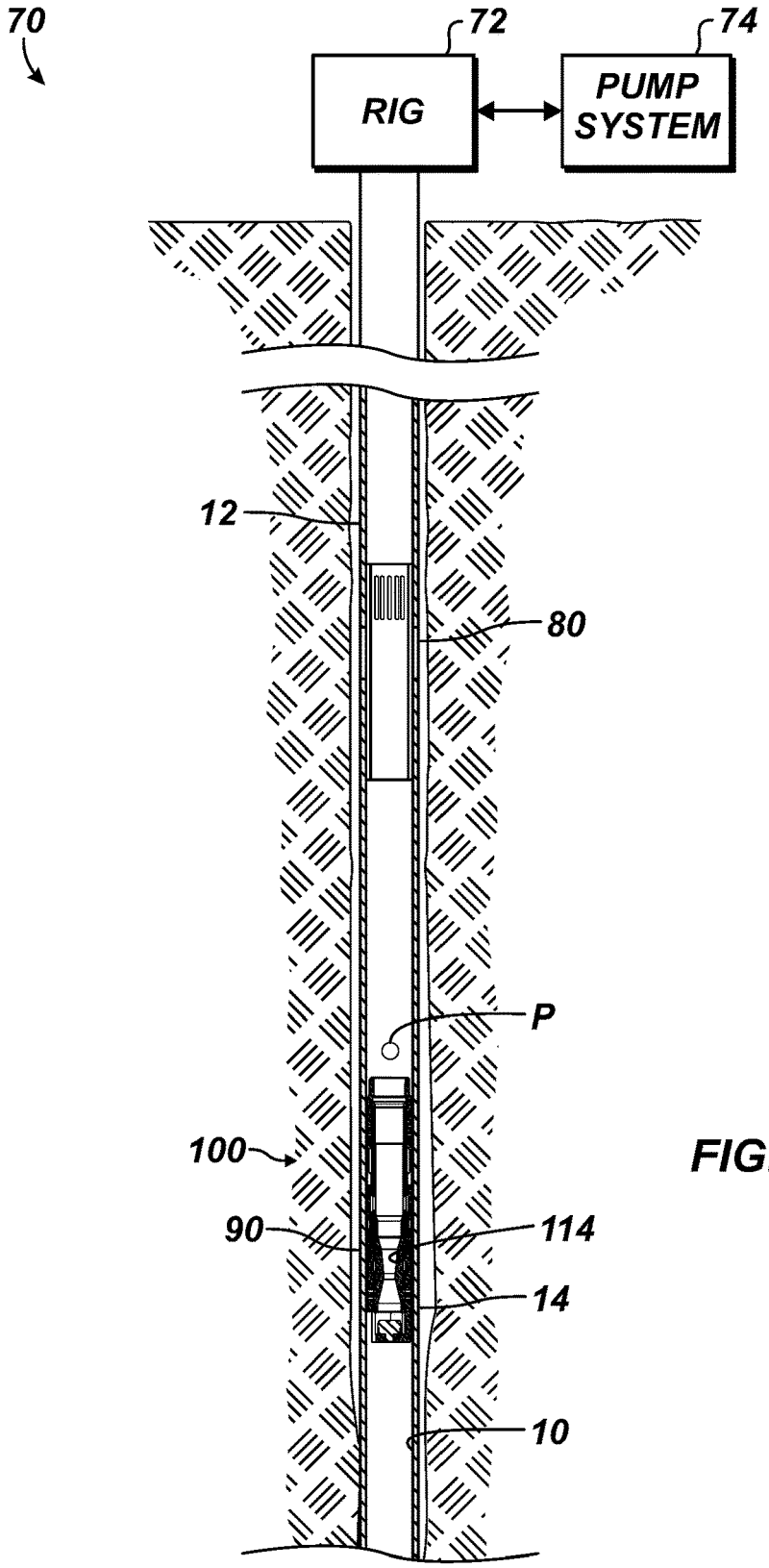
FIG. 3 illustrates a tubing string having a retrievable plugging tool according to the present disclosure.

FIG. 3 illustrates a tubing string 12 having a locking ball landing tool 100 according to the present disclosure. The locking ball landing tool 100 of the present disclosure is retrievable and operates as a plugging tool or bridge plug in the tubing string 12. The plugging tool 100 is run into the wellbore 10 at a desired location 14 on the tubing string 12. Only one such plugging tool 100 is shown in FIG. 3, but a given installation may have multiple plugging tools 100.

When operations are ready, the plugging tool 100 is set by deploying an object (e.g., ball P, dart, or other plug) in the tubing string 12. Once the plug P reaches the retrievable plugging tool 100, the plug P lands in a seat 114 in the plugging tool 100. Fluid pressure down the tubing string 12 causes an increase of pressure that moves the seat 114 to lock in a closed position in the retrievable plugging tool 100. This isolates zones above and below the plugging tool 100.

Figure 5:
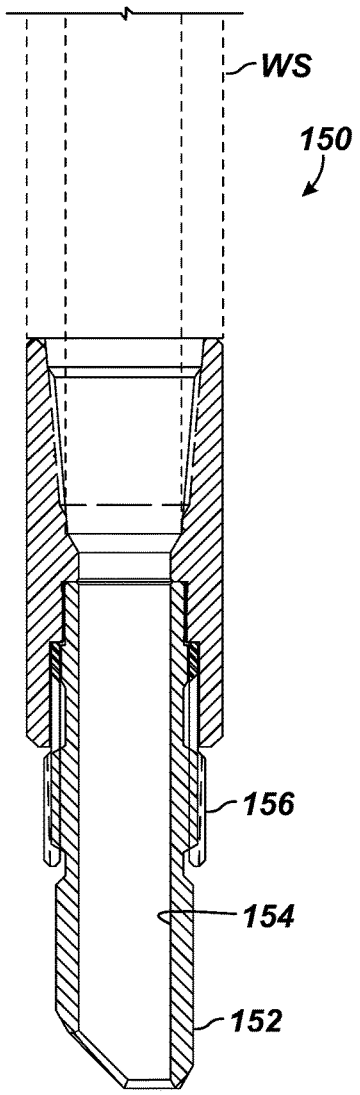
FIG. 5 illustrates a cross-sectional view of a retrieval tool for the disclosed plugging tool.

As can be seen, the retrievable plugging tool 100 does not require an extra trip in the hole to set an obstruction, such as a bridge plug or other plugging element. Instead, deploying the plug P and pumping pressure downhole is all that is required to create the isolation in the tubing string 12. Once certain operations have been performed with the plugging tool 100 isolating sections of the tubing string 12 above and below it, the obstruction of the plugging tool 100 can be removed. To remove the retrievable plugging tool 100 (which removes the isolation between the zones), the plugging tool 100 is retrieved using a retrieval tool (150: FIG. 5). The retrieval leaves behind a body or tubing coupling 90 that approximately matches the size/weight of the tubing string 12 (albeit, the body 90 may have a slightly smaller internal restriction due to design constraints). Alternatively, the plugging tool 100 may be drilled out instead.

Figure 1:
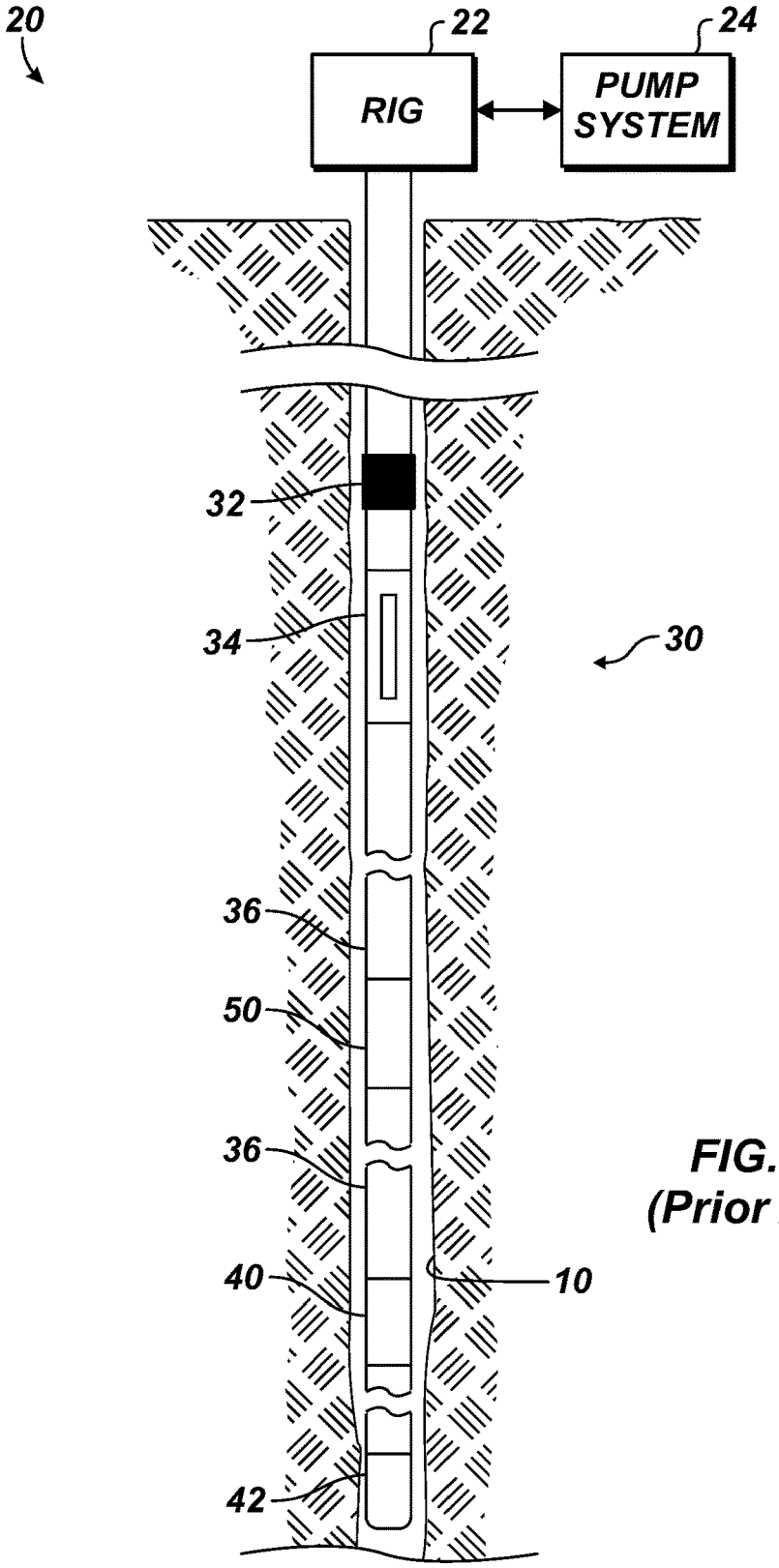
FIG. 1 (Prior Art)
FIG. 1 illustrates a liner hanger system according to the prior art.
Figure 2:
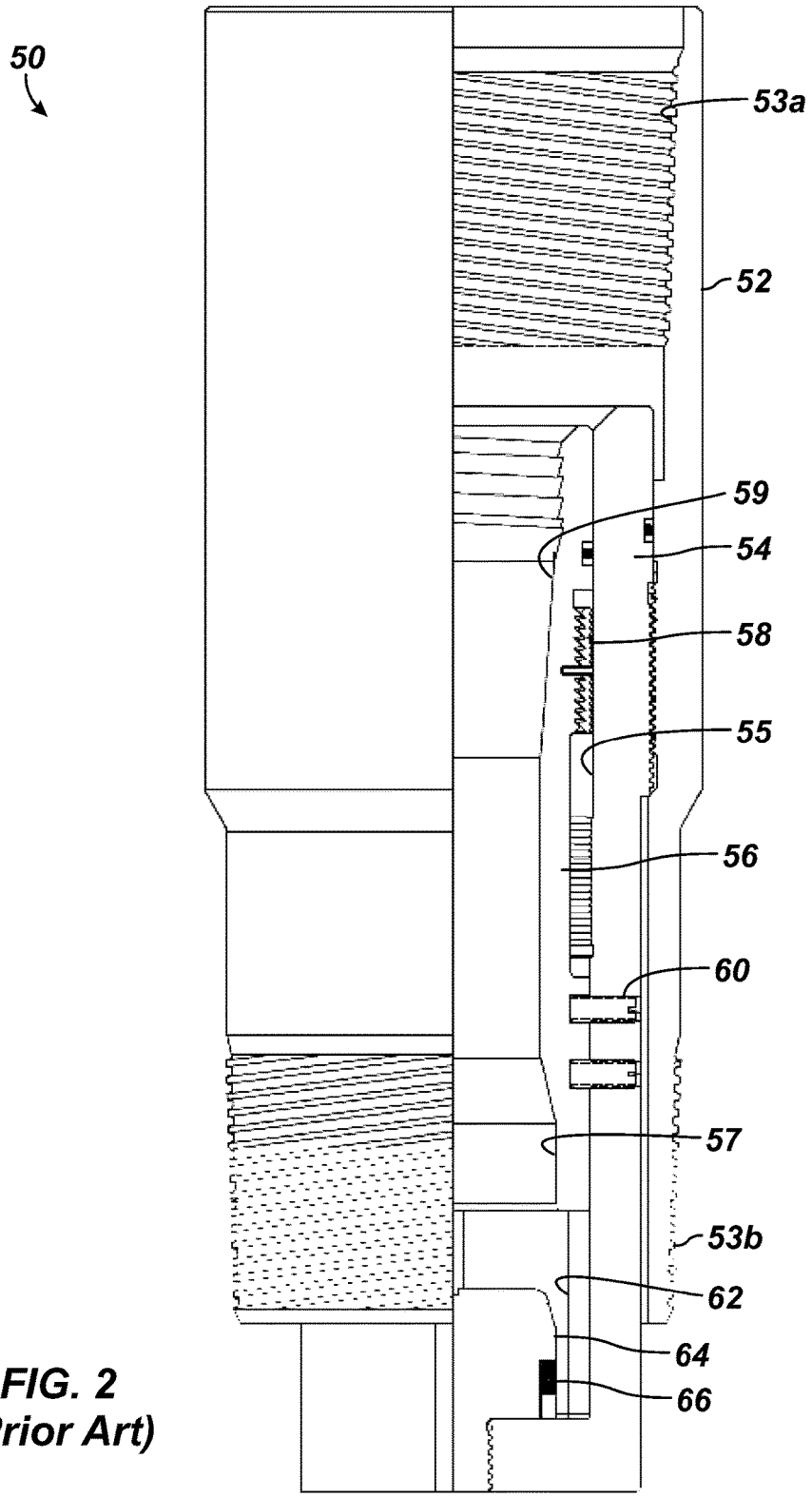
FIG. 2 (Prior Art)
FIG. 2 illustrates a partial cross-sectional view of a locking ball landing collar according to the prior art for use with a liner hanger system.

As one particular example, the plugging tool 100 can be used with a liner system, such as discussed previously with reference to FIG. 1. Accordingly, when the plugging tool 100 has been set, for example, the plugging tool 100 isolates pressure above it, after circulation, in order to actuate other hydraulic components in the liner system. In another example, the plugging tool 100 can be used in a plug-and-perf operation. In this case, the plug P can be dropped from surface or from a perforating gun already inserted in the tubing 12 so the plug P can close the plugging tool 100. Then, the perforating tool can be raised in the tubing string 12 above the tool 100 to perforate the tubing 12, and subsequent treatment, fracture, or the like can be performed.

The plugging tool 100 can be used in other systems as well. For instance, because the plugging tool 100 can be used as a bridge plug, fracture plug, or the like in the tubing string 100, the disclosed plug 100 can therefore be used in any number of operations and assemblies in which such a bridge plug, fracture plug, and the like are used.

As shown in FIG. 3, for example, a treatment system 70 has a tool 80 disposed on the tubing 12 uphole of the plugging tool 100. This other tool 80 can be a hydraulically-actuated tool, such as a sliding sleeve, packer, etc. When it is desired to actuate the tool 80, operators deploy the plug P from the rig 72 down the tubing string 12 to the plugging tool 100 and use a pumping system 74 to close the plugging tool 100. With flow isolated by the closed tool 100, a build-up of fluid pressure can then actuate the tool 80 and perform other actions. For instance, the tool 80 can be a hydraulically-operated sliding sleeve that is opened to perform fracture operations. Several arrangements of such sleeves 80 and plugging tools 100 can be disposed along the tubing string 10 for use in multi-zone completion and fracturing operations.

In another example, the other tool 80 disposed on the tubing 12 in the treatment system may be a plug or ball-actuated tool that opens/closes with the plug P and then passes the plug P further downhole. For example, the tool 80 can be a sliding sleeve that opens with pressure applied against the plug P seated in the tool 80. Then, the tool 80 can pass the plug P out of the tool 80 for traveling further downhole to the tool 100. In fact, a cluster of such sliding sleeve tools 80 can be used along the tubing string 12 and can be opened with the same plug P, which eventually reaches the disclosed plugging tool 100. In this way, a cluster of sliding sleeve tools 80 can be opened along an interval on the tubing string 12 for treatment, fracture, or the like to be performed.

Figure 4:
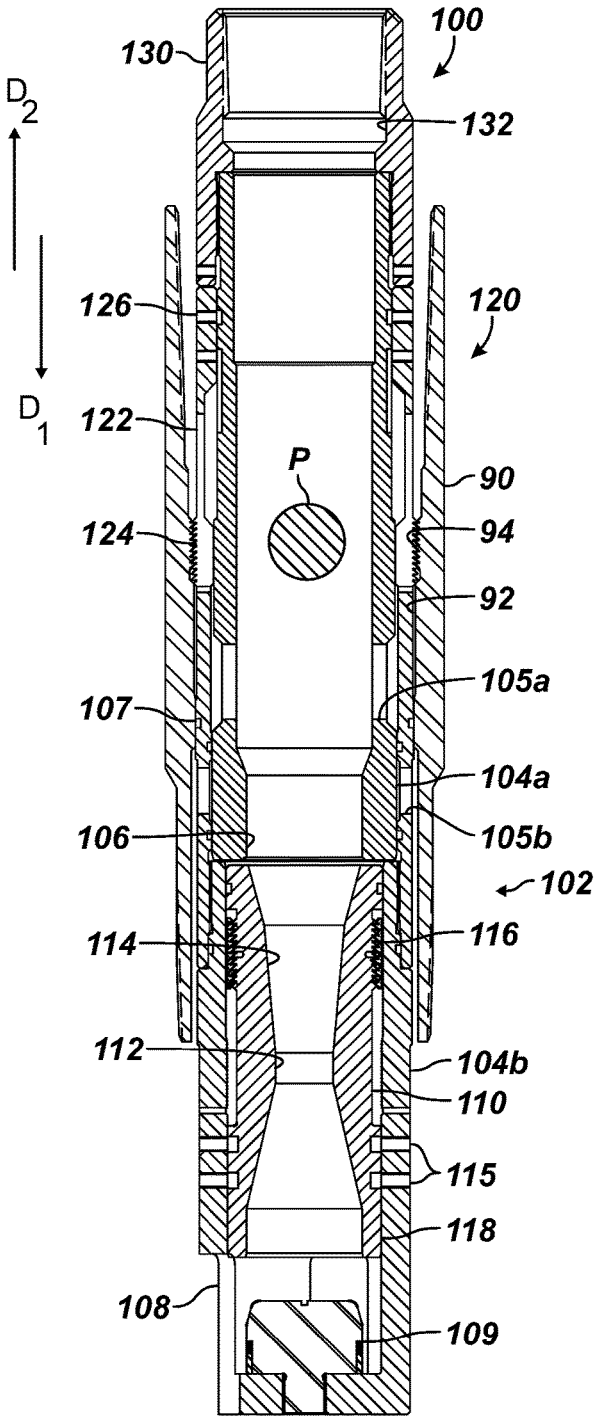
FIG. 4 illustrates a cross-sectional view of the retrievable plugging tool.

With a general understanding of the disclosed plugging tool 100 and its uses, discussion turns now to FIG. 4, which illustrates a cross-sectional view of the retrievable plugging tool 100 of the present disclosure. The plugging tool 100 is used with a retrieval tool 150, which is shown in a cross-sectional view of FIG. 5. Use of the retrieval tool 150 with the plugging tool 100 is shown in various stages of FIGS. 6A-6D.

As shown in FIG. 4, the plugging tool 100 includes a tool body 102 defining a bore 106 with a port 108 permitting fluid communication therethrough. The body 102 is disposed in the tubing (not shown) and has a landing 120 engaged in first and second opposite longitudinal directions in the tubing. In particular, the plugging tool 100 is disposed in the body or tubing coupling 90 that connects to sections of tubing (not shown) above and below at a particular location on the tubing string. When the tubing string is deployed, the plugging tool 100 can be pre-assembled and installed at surface in the tubing coupling 90 for later use during operations.

Looking at the plugging tool 100 in more detail, the landing 120 includes a collet having a plurality of fingers 122 extending in a first (downhole) longitudinal direction D1. The heads 124 of the fingers 120 engage with a profile 94 in the tubing coupling 90. As specifically shown, the fingers' heads 124 define first ratchet locks on an exterior thereof. These first ratchet locks can lock with second ratchet locks of the profile 94 in the first (downhole) longitudinal direction D1, but can release therefrom in the second (uphole) longitudinal direction D2.

The tool body 120 has an external seal 107 engageable in the tubing coupling 90. The external seal 107 isolates fluid communication in an annulus between the tool body 102 and the tubing coupling 90. To help with sealing, the tubing coupling 90 can have a sealing surface 92 therein for engaging the external seal 107 on the tool body 102 disposed therein.

Inside the tool body 102, a seat 110 is disposed in the bore 106 and permits fluid communication therethrough. In particular, the seat 110 has the form of a sleeve disposed in the body's bore 106 and includes an internal passage 112 with a seating surface 114 at one end. The other end 118 of the seat 110 is open to the bore 106 of the tool body 102.

At its end, the tool body 102 has a central stub 109 with seals. The port 108 is defined in a side of the tool body 102 adjacent the central stub 109. The seat 110 is temporarily held by shear screws 115 in an open condition relative to the port 108. When the seat 110 shifts to the closed condition (FIG. 6A), the seat's end 118 inserts on the central stub 109 and covers the port 108 to block fluid flow in both directions.

As noted previously, use of the plugging tool 100 and the retrieval tool 150 is illustrated in stages in FIGS. 6A-6D. During operations, the seat 110 is initially in its upward position (FIG. 4). When operators desire to isolate sections of tubing above and below the plugging tool 100, the plug P is deployed down the tubing string to the seat 100. Fluid pressure applied behind the plug P in the seat 110 then moves the seat 110 in the bore 106 from the opened condition (FIG. 4) to a closed condition (FIG. 6A) relative to the body's port 108. The seat 110 in the closed condition (FIG. 6A) closes off fluid communication through the tool body 102 and the port 108 regardless of the seating of the plug P in the seat 110, which makes use of the plugging tool 100 well-suited for use in horizontal or deviated wellbores. An external lock 116, such as a body lock ring or other mechanism, on the seat 110 engages with the bore 106 (i.e., engages a ratchet thread on the inside of the second portion 104*b*) to hold the seat 110 in the closed condition (FIG. 6A) in the bore 106 once shifted by the plug P.

Any of the desired operations can then be performed while the closed seat 110 on the stud 109 prevents uphole fluid pressure from passing through the plugging tool 100 and prevents downhole pressure from passing up through the plugging tool 100, thereby enabling the plugging tool 100 to operate as a bridge plug in the tubing string.

At some point during operations, it may be desirable to remove the obstruction from the plugging tool 100 and make the tubing string 100 a substantially uniform and unobstructed passage to the various zones in the wellbore. To remove the plugging tool 100, operators run the retrieval tool 150 (FIG. 5) on a workstring WS to the plugging tool 100. As shown in the isolated view of FIG. 5, the retrieval tool 150 includes a catch 156 and a stinger 152 with a fluid passage 154 therethrough.

Figures 6A, 6B, 6C:
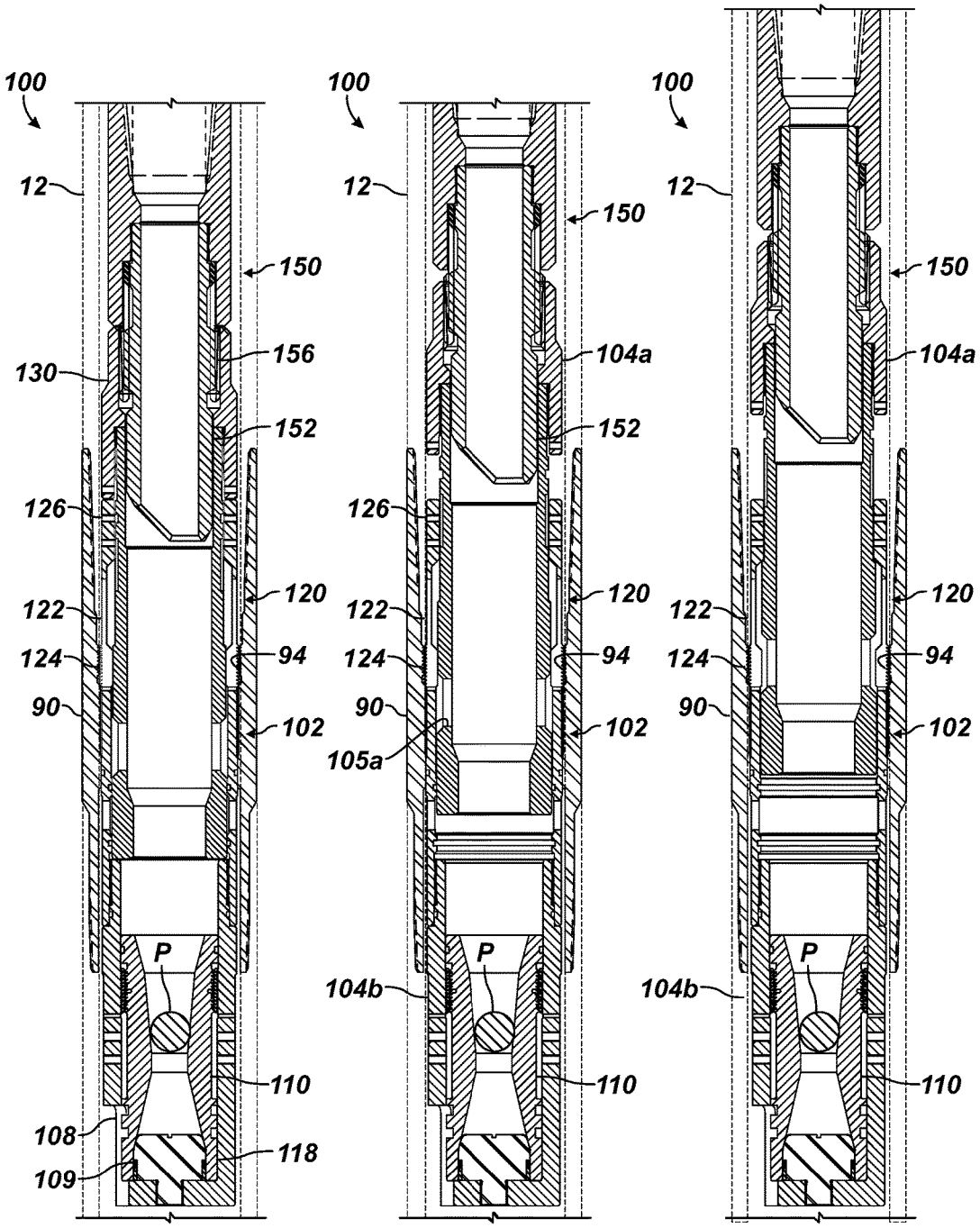
FIGS. 6A-6D illustrate the disclosed plugging tool and retrieval tool during stages of operation.

As shown in FIG. 6A, the retrieval tool 150 is inserted in the tubing with the workstring WS to the tool body 102 to disengage the landing 102 from the tubing coupling 90 in the second (uphole) longitudinal direction D2. In this way, the retrieval tool 150 can retrieve the tool body 102 and the seat 110 (along with the plug P if present) together from the coupling 90 and the tubing.

To do this as shown in FIG. 6A, the stinger 152 on the tool 150 inserts into the end 130 of the plugging tool's body 102, and the catch 156 engages in a profile 132 defined in the end 130. The catch 156 can be a collet movably disposed on the stinger 152 for engaging the profile 132.

Figure 6D:
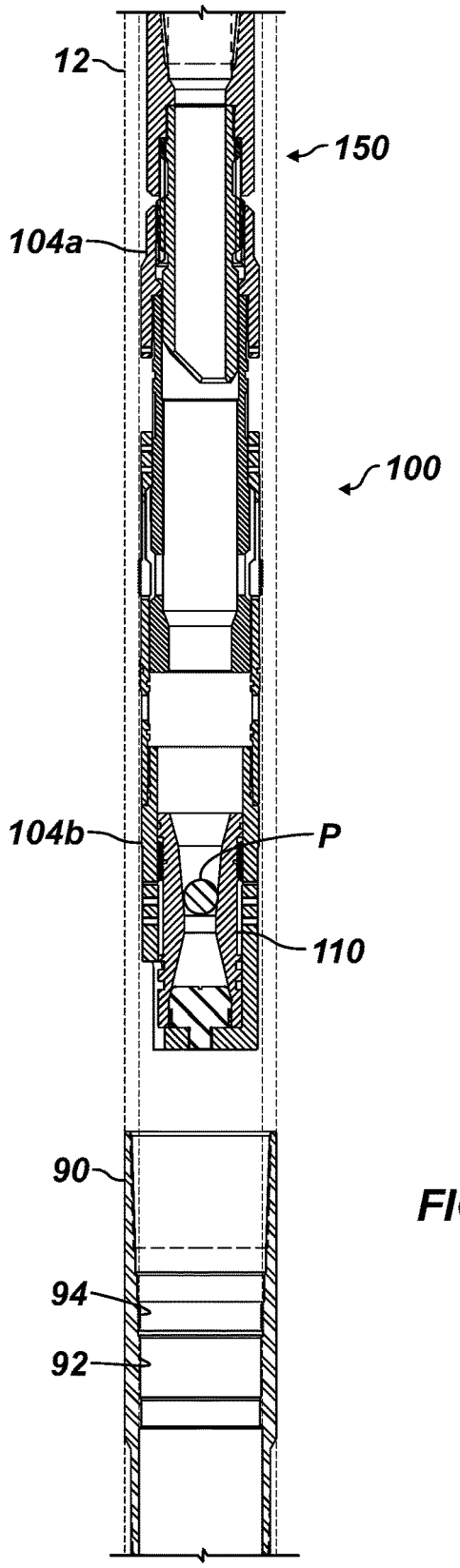

For its part, the body 102 can include first and second portions 104*a-b* movable relative to one another from a set condition (FIGS. 4 & 6A) to an unset condition (FIGS. 6B-6D). The first (upper) portion 104*a* has the end 130 and primarily defines the bore 106 through the body 102. The second (lower) portion 104*b* has the first portion 104*a* partially inserted therein. The second portion 104*b* has the seat 110, the stud 109, and the landing 120. The first portion 104*a* in the set condition relative to the second portion 104*b* holds the landing 120 engageable in the first and second longitudinal directions D1-2 in the tubing coupling 90. A temporary connection 126 near the landing 120 and the end 130 affixes the first and second portions 104*a-b* in the set condition. However, the first portion 104*a* in the unset condition relative to the second portion 104*b* releases the landing 120 from engagement in the second (uphole) longitudinal direction D2.

With the stinger 152 of the tool 150 inserted in the end 130 and with the lock 156 engaged in the profile 132 as shown in FIG. 6A, upward pull of the tool 150 eventually shears the temporary connection 126 between the first and second portions 104*a-b*. As a result and as shown in FIG. 6B, the first portion 104*a* shears free of the second portion 104*b*, which is still held in place in the coupling 90 by the landing 120.

To overcome fluid pressure existing during pull up and to deal with potential debris, the body 102 has internal ports 105*a-b*. In particular, the first portion 104*a* defines a first intermediate port 105*a* permitting fluid communication of the bore 106 outside the body 102. The second portion 104*b* defines a second intermediate port 105*a*, which is sealed from fluid communication with the bore 106 when the first portion 104*a* is in the set condition.

Yet, the first portion 104*a* in the unset condition (FIG. 6B) permits fluid communication between the ports 105*a-b* and bore 106. The ports 105*a-b* allow any built up debris to be displaced to the bore 106 so that the debris does not interfere with the release of the inner components. The second port 105*b* can help equalize the fluid pressure across the plugging tool 100. In this way, flow between the uphole and downhole tubing sections can then be established past the seal 107 by virtue of the ports 105*a-b* and bore 106.

It should be noted that the configuration of the tool 100 prevents the first and second portions 104*a-b* from releasing prematurely (i.e. when there is still fluid pressure from below the tool 100). In this way, any fluid pressure from below the tool may not be able to drive the tubing string out of the hole because the first portion 104*a* is still locked into the coupling 90.

Further uphole pull of the tool 150 removes the first portion 104*a* further from the second portion 104*b*. Eventually as shown in FIG. 6C, the collet heads of the landing 120 reach a reduced profile of the first portion 104*a*, which releases the compressed locking of the landing 120 to the coupling's profile 94.

Finally as shown in FIG. 6D, the first and second portions 104*a-b* shoulder against one another. Further lifting of the tool 150 thereby lifts the first portion 104*a* and pulls the second portion 104*b* from the coupling 90. The entire assembly can then be lifted to surface. The coupling 90 remains in the tubing string 12 and does not considerably reduce the internal dimension of the tubing's through-bore.

If additional plugging tools 100 are disposed further downhole on the tubing string 12, the above operations can be repeated to remove the next lower plugging tool 100 disposed at its coupling 90 on the tubing string 12. Should it be desired or should a given plugging tool 100 not be retrievable for whatever reason, operators can mill out the plugging tool 100 using standard milling procedures.

As noted previously, the plugging tool 100 can be used with a liner system, such as discussed previously with reference to FIG. 1. In such an implementation, only one plugging tool 100 would typically be run with the liner system. Also as noted previously, the plugging tool 100 can be used in other systems, such as those implementations in which several of the plugging tools 100 can be used. As an example, FIGS. 7A-7D illustrate stages of an operation using a plurality of plugging tools 100A-C according to the present disclosure.

Figures 7A, 7B, 7C, 7D:
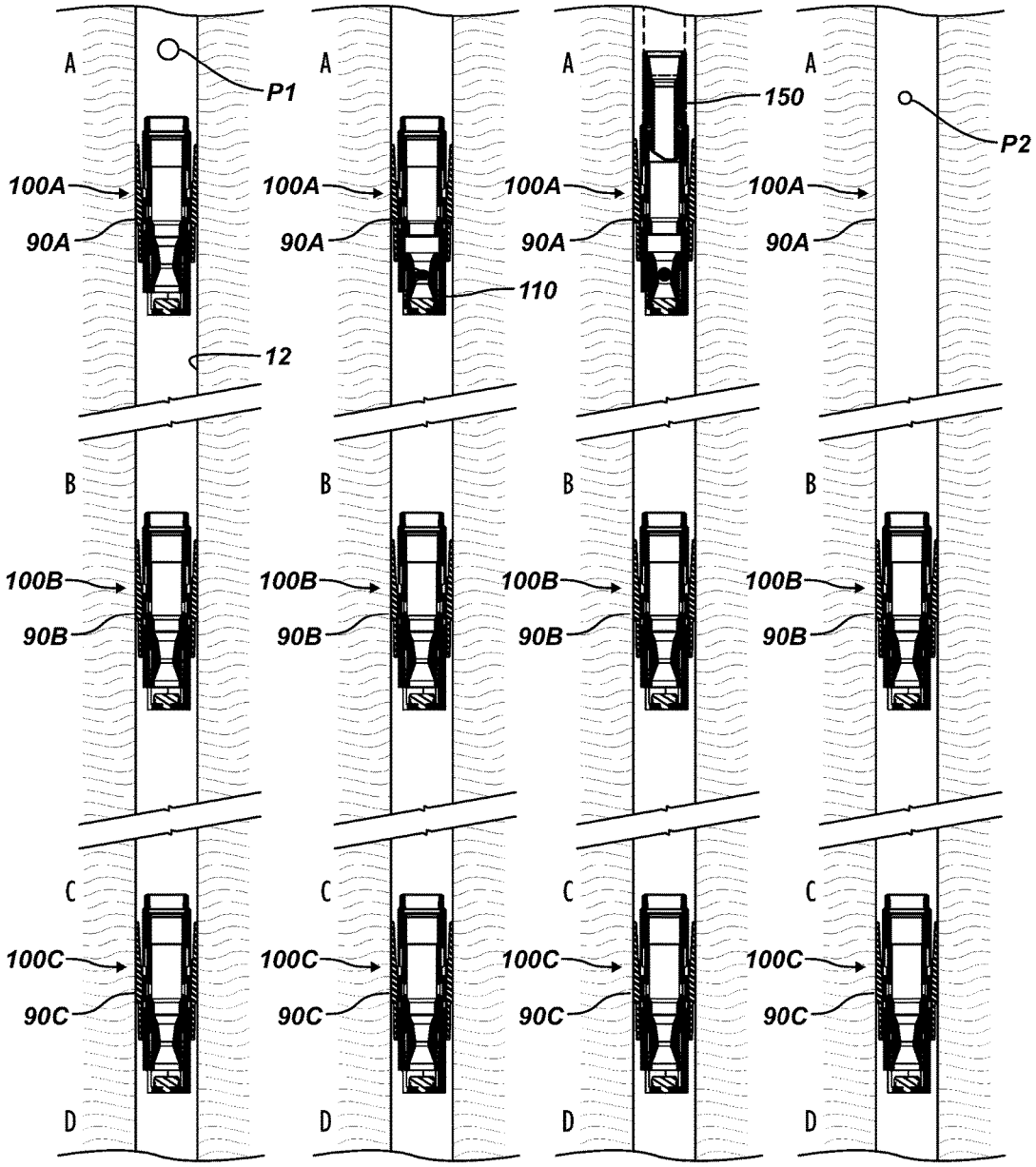
FIGS. 7A-7D illustrates stages of an operation using a plurality of plugging tools according to the present disclosure.

As shown in FIG. 7A, tubing 12, such as casing or other tubular, passes through several zones A-D downhole in a well. Several couplings 90A-C disposed on the tubing 12 support plugging tools 100A-C of the present disclosure. Each downhole zone A-D can have additional components (not shown) disposed on the tubing 12, such as fracture sleeves, hydraulically-actuated sleeves, ball-actuated sleeves, packers, or other tools. Alternatively, the tubing 12 can have perforations, ports, or the like in the zones A-D.

When operations are ready, the first (upper) plugging tool 100A is set by deploying an object (e.g., ball P1, dart, or other plug) in the tubing string 12. Once the first plug P1 reaches the first tool 100A, the plug P1 lands in the seat 114 in the tool 100A. Then as shown in FIG. 7B, fluid pressure down the tubing string 12 causes an increase of pressure that moves the seat 114 to lock in a closed position in the first tool 100A. This isolates zones above and below the plugging tool 100A.

At this point, operations can be performed in the first zone A by fracturing the zone A, actuating a tool (not shown), setting a packer, etc. For example, the first plug P1 may have been used to open one or more first sliding sleeves (not shown) along the tubing 12 in the first zone A. When the first plug P1 lands and closes the first tool 100A, operations can treat the formation of zone A through those one or more open sleeves (not shown).

Once operations are done with the first zone A, the retrieval tool 150 as shown in FIG. 7C can be deployed to retrieve the first tool 100A along with the first plug P1 from the tubing 12. As shown in FIG. 7C, this then makes the next tool 100B at the next zone B available for operations. A second plug P2 can then be deployed down the tubing 12 to this second tool 100B to close it and perform additional operations.

As will be appreciated, the second plug P2 can be used to close any open sliding sleeves or deactivate any tools along the tubing 12 in the first zone A and may comparably open any additional sliding sleeves or activate other tools along the tubing 12 in the second zone B. As will also be appreciated, it is possible that deployment of the retrievable tool 150 may be used to close any open sliding sleeves or deactivate any tools along the tubing 12 in the first zone A by using shifting tools (not shown) or the like.

When the second tool 100B is closed and operations have been performed, the entire process of retrieving the tool 100B and completing the steps noted above can be repeated for the next zone C and tool 100C along the tubing 12.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus actuated by an object for isolating a zone in tubing, the apparatus comprising:

a body disposed in the tubing and having a landing engaged at least in a first longitudinal direction in the tubing, the body defining a bore with an opening permitting fluid communication through the body;

a seat disposed in the bore of the body, the seat engageable with the object and movable in the bore with the engagement from an opened condition to a closed condition relative to the opening, the seat in the closed condition closing off fluid communication through the opening regardless of the seating of the object in the seat; and a tool insertable in the tubing to the body, the tool disengaging the landing from the tubing in a second longitudinal direction, opposite to the first longitudinal direction, and retrieving the body and the seat together from the tubing.

2. The apparatus of claim 1, wherein the landing comprises a collet having a plurality of fingers extending in the first longitudinal direction, the fingers engageable with a profile in the tubing.

3. The apparatus of claim 2, wherein the fingers define first ratchet locks on an exterior thereof, the first ratchet locks lockable with second ratchet locks of the profile in the first longitudinal direction and releasable therefrom in the second longitudinal direction.

4. The apparatus of claim 1, wherein the seat comprises a sleeve disposed in the body.

5. The apparatus of claim 1, wherein the seat comprises a lock engageable with the bore of the body, the lock holding the seat in the closed condition in the bore.

6. The apparatus of claim 1, wherein the body comprises a central stub on an end thereof, the opening defined in a side of the body adjacent the central stub, the seat in the closed condition inserted on the central stub and covering the opening.

7. The apparatus of claim 1, wherein the body comprises first and second portions movable relative to one another from a set condition to an unset condition, the second portion having the landing, the first portion moved in the set condition relative to the second portion holding the landing engageable in both the first and second longitudinal directions in the tubing, the first portion moved in the unset condition relative to the second portion releasing the landing from engagement in the second longitudinal direction.

8. The apparatus of claim 7, wherein a temporary connection affixes the first and second portions in the set condition.

9. The apparatus of claim 7, wherein the second portion defines an intermediate port, the first portion moved in the set condition preventing fluid communication between the bore and the intermediate port, the first portion moved in the unset condition permitting fluid communication between the bore and the intermediate port.

10. The apparatus of claim 9, wherein the first portion defines another intermediate port permitting fluid communication of the bore outside the body.

11. The apparatus of claim 10, wherein the body comprises an external seal disposed about the second portion and being engageable in the tubing, the external seal isolating fluid communication in an annulus between the body and the tubing.

12. The apparatus of claim 1, wherein the tool comprises a catch engageable in a profile defined in the bore of the body.

13. The apparatus of claim 12, wherein the tool comprises a stinger at least partially insertable in the bore of the body, and wherein the catch comprises a collet movably disposed on the stinger.

14. The apparatus of claim 1, wherein the apparatus comprises a coupling disposed on the tubing, the coupling having a profile for engagement with the landing on the body.

15. The apparatus of claim 14, wherein the coupling defines a sealing surface therein for engaging an external seal on the body disposed therein.

16. A method of isolating a zone in tubing, the method comprising:

holding a body downhole in the tubing with a landing engaged in at least a first longitudinal direction in the tubing;

permitting fluid communication through a bore in the body and through a seat disposed in the bore;

moving the seat from an opened condition to a closed condition relative to an opening in the bore by engaging the seat with an object deployed in the tubing;

closing off, with the seat in the closed condition, fluid communication through the bore regardless of the seating of the object in the seat; and retrieving the body and the seat together from the tubing by disengaging the landing from the tubing in a second longitudinal direction, opposite to the first longitudinal direction, with a tool inserted in the tubing.

17. The method of claim 16, wherein holding the body in the tubing with the landing engaged in at least the first longitudinal direction in the tubing comprises assembling the body and the landing in the tubing at surface.

18. The method of claim 16, wherein moving the seat from the opened condition to the closed condition relative to the opening in the bore comprises locking the seat in the closed condition in the bore.

19. The method of claim 16, wherein closing off the fluid communication through the bore regardless of the seating of the object in the seat comprises interposing an end of the seat on a stub in the bore of the body and closing off communication through the opening in the bore adjacent the stub.

20. The method of claim 16, wherein disengaging the landing from the tubing in the second longitudinal direction with the tool inserted in the tubing comprises disengaging a first portion of the body from a second portion of the body and releasing the engagement of the landing.

21. The method of claim 16, wherein disengaging the first portion of the body from the second portion of the body comprises equalizing fluid communication across the body by opening intermediate ports between the first and second portions.

22. The method of claim 16, further comprising actuating at least one tool uphole on the tubing string in response to closing off the fluid communication through the bore.

23. The method of claim 16, further comprising actuating at least one tool uphole on the tubing string with the object deployed in the tubing before engaging the seat in the body.

* * * * *